US011168531B1

(12) United States Patent
Nguyen

(10) Patent No.: US 11,168,531 B1
(45) Date of Patent: Nov. 9, 2021

(54) WINDOW MILL INCLUDING A HYDRAULIC LINE CONNECTOR

(71) Applicant: Tuan Nguyen, Pearland, TX (US)

(72) Inventor: Tuan Nguyen, Pearland, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 16/867,639

(22) Filed: May 6, 2020

(51) Int. Cl.
*E21B 29/06* (2006.01)

(52) U.S. Cl.
CPC ..... *E21B 29/06* (2013.01)

(58) Field of Classification Search
CPC ..... E21B 29/06
See application file for complete search history.

(56) References Cited

U.S. PATENT DOCUMENTS 4,341,273 A 7/1982 Walker et al.
5,443,129 A * 8/1995 Bailey ..... E21B 7/061 175/45
9,004,159 B2 * 4/2015 Alsup ..... E21B 10/43 166/117.5
2007/0044954 A1 * 3/2007 Dewey ..... E21B 4/02 166/55
2010/0012322 A1 1/2010 McGarian
2011/0155468 A1 * 6/2011 Gregurek ..... E21B 7/061 175/61
2012/0261193 A1 * 10/2012 Swadi ..... E21B 7/061 175/61
2013/0319653 A1 * 12/2013 Ibragimov ..... E21B 7/061 166/117.6
2018/0320448 A1 11/2018 Hern et al.
2019/0100966 A1 * 4/2019 Parkin ..... E21B 47/00

FOREIGN PATENT DOCUMENTS

WO 2020010283 A1 1/2020

OTHER PUBLICATIONS

International Search Report and Written Opinion for International Application No. PCT/US2021/030851; International Filing Date May 5, 2021; Report dated Aug. 24, 2021 (pp. 1-10).

* cited by examiner

*Primary Examiner* — Taras P Bemko
(74) *Attorney, Agent, or Firm* — Cantor Colburn LLP

(57) ABSTRACT

A window mill includes a body having a first end, a second end, and an intermediate portion extending therebetween. A passage is formed in the body extending from the first end toward the second end. An opening extends through the second end and fluidically connects to the passage. A hydraulic line connector extends through the opening into the passage. The hydraulic line connector includes a first portion having an inlet arranged in the passage, a second portion that projects outwardly of the second end of the body, a longitudinal axis defined between the first portion and the second portion, and a frangible zone arranged between the first portion and the second portion. At least one of the first portion and the second portion includes a debris filter.

18 Claims, 10 Drawing Sheets

WINDOW MILL INCLUDING A HYDRAULIC LINE CONNECTOR

BACKGROUND

In the resource exploration and recovery industry, the formation of boreholes for the purpose of locating, testing, and/or extracting downhole fluids. In some cases, a casing tubular may be used to support the borehole. When a branch well is formed, an exit is made in the casing tubular. Mills and drill bits supported on a tubular that is run into the borehole may be employed to form a casing exit. A departure mechanism may be activated through pressure differentials created between an interior of the tubular and an annulus about the tubular.

A hydraulic line may extend along the tubular to the departure mechanism. Occasionally, debris may enter into the hydraulic line and create a blockage. The blockage may prevent actuation of the departure system. If the hydraulic line becomes even partially blocked, components of the departure mechanism may be lost downhole. Accordingly, the art would appreciate a system that would prevent any blockage of the departure system hydraulic line.

SUMMARY

Disclosed is a window mill including a body having a first end, a second end, and an intermediate portion extending therebetween. A passage is formed in the body extending from the first end toward the second end. An opening extends through the second end and fluidically connects to the passage. A hydraulic line connector extends through the opening into the passage. The hydraulic line connector includes a first portion having an inlet arranged in the passage, a second portion that projects outwardly of the second end of the body, a longitudinal axis defined between the first portion and the second portion, and a frangible zone arranged between the first portion and the second portion. At least one of the first portion and the second portion includes a debris filter.

Also disclosed is a resource exploration and recovery system including a first system and a second system including a tubular string fluidically connected to the first system and extending into a wellbore. The tubular string supports a window mill including a body having a first end, a second end, and an intermediate portion extending therebetween, a passage formed in the body extending from the first end toward the second end, and an opening extending through the second end and fluidically connected to the passage. A hydraulic line connector extends through the opening into the passage. The hydraulic line connector includes a first portion having an inlet arranged in the passage, a second portion that projects outwardly of the second end of the body, a longitudinal axis defined between the first portion and the second portion, and a frangible zone arranged between the first portion and the second portion. At least one of the first portion and the second portion includes a debris filter.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
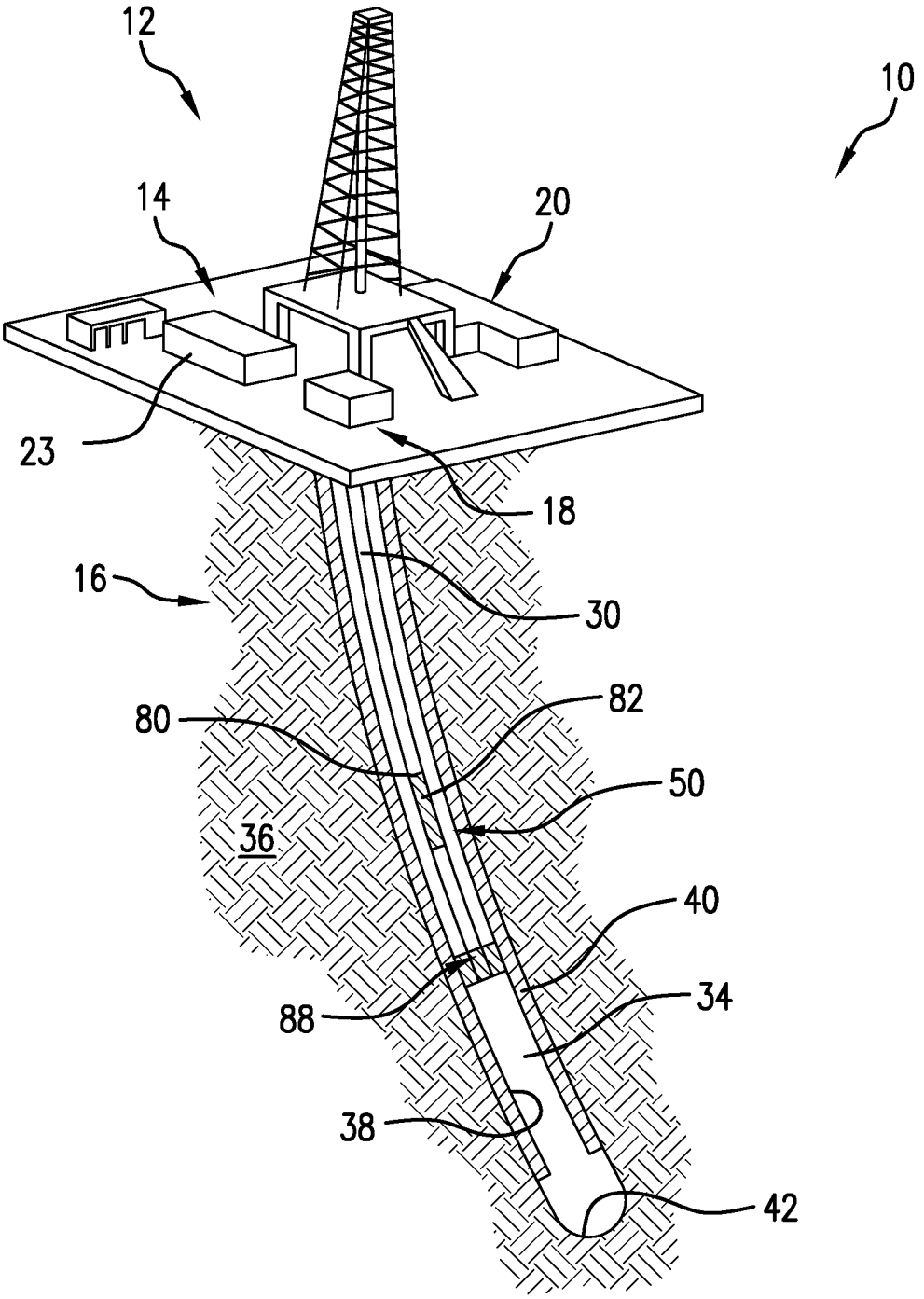
FIG. 1 depicts a resources exploration and recovery system including a window mill having a hydraulic line connector, in accordance with an exemplary embodiment.

A resource exploration and recovery system, in accordance with an exemplary embodiment, is indicated generally at 10, in FIG. 1. Resource exploration and recovery system 10 should be understood to include well drilling operations, resource extraction and recovery, $CO_2$ sequestration, and the like. Resource exploration and recovery system 10 may include a first system 12 which, in some environments, may take the form of a surface system 14 operatively and fluidically connected to a second system 16 which, in some environments, may take the form of a subsurface system.

First system 12 may include pumps 18 that aid in completion and/or extraction processes as well as fluid storage 20. Fluid storage 20 may contain a stimulation fluid which may be introduced into second system 16. First system 12 may also include a control system 23 that may monitor and/or activate one or more downhole operations. Second system 16 may include a tubular string 30 formed from a plurality of tubulars (not separately labeled) that is extended into a wellbore 34 formed in formation 36. Wellbore 34 includes an annular wall 38 that may be defined by a casing tubular 40 that extends from first system 12 towards a toe 42 of wellbore 34.

Figure 2:
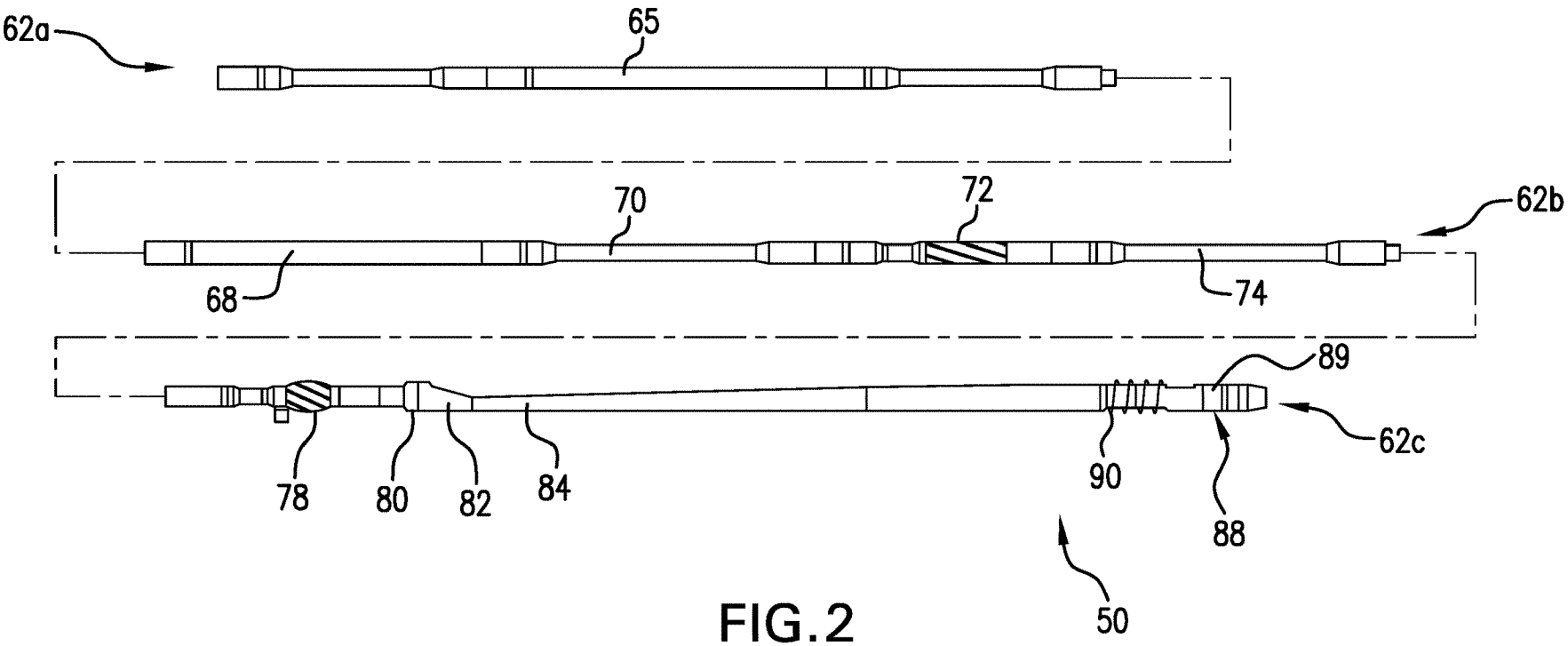
FIG. 2 depicts a window cutting system including the window mill of FIG. 1, in accordance with an exemplary embodiment.

In accordance with an exemplary aspect, a window cutting system 50 is connected to tubular string 30 as is introduced into wellbore 34. Window cutting system 50 is lowered to a selected depth, affixed to casing tubular 40, and activated to form a window. The window represents an opening in casing tubular 40 that allows a branch to be formed from wellbore 34. In the embodiment shown, window cutting system 50 is formed from a number of tubular segments 62*a*, 62*b*, and 62*c* as shown in FIG. 2. Each tubular segment 62*a*, 62*b*, and 62*c* may be made up off-site and delivered to first system 12 for introduction into wellbore 34.

In an embodiment, first segment 62*a* may support a measurement while drilling (MWD) system 65 that includes various instrumentation systems that monitor window cutting operations. Second segment 62*b* may include a whipstock valve 68, a first flex joint 70, an upper watermelon mill 72, and a second flex joint 74. Third segment 62*c* may include a lower watermelon mill 78, a window mill 80, a whipstock connector 82, a whipstock 84, and an anchor 88 having one or more slips 89. Third segment 62*c* may also support a brush or scraper 90 arranged adjacent to anchor 88.

Figure 3:
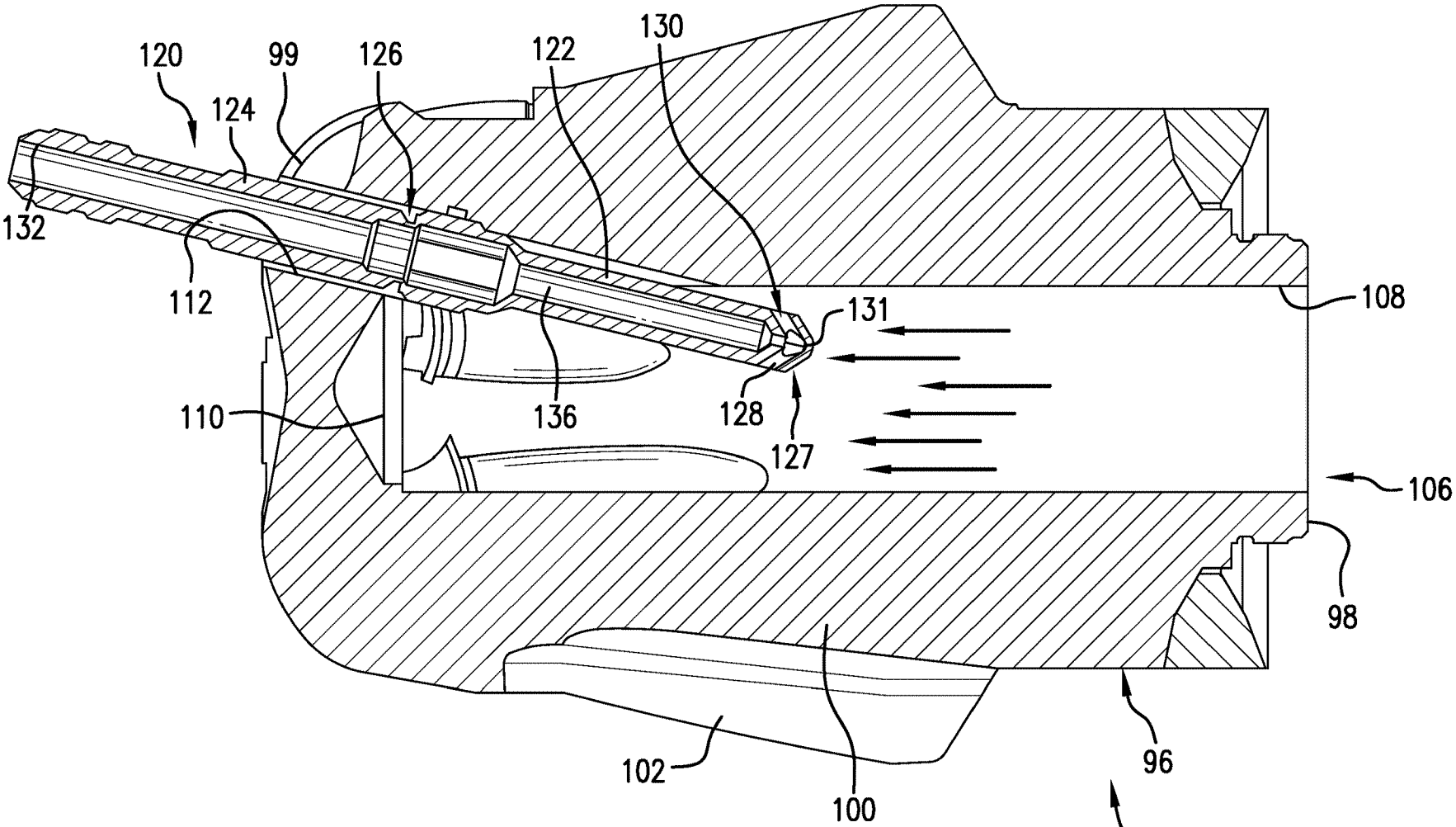
FIG. 3 depicts a cross-sectional side view of a window mill including a hydraulic line connector, in accordance with an exemplary aspect.

Referring to FIG. 3, window mill 80 includes a body 96 having a first end 98 that may be coupled to, for example, lower watermelon mill 78, a second end 99 that may be connected to whipstock connector 82, and an intermediate portion 100 that supports one or more cutting elements 102. A passage 106 extends from first end 98 toward second end 99. Passage 106 includes a first end section 108 that is positioned at first end 98 and a second end section 110 that is spaced from second end 99. An opening 112 extends from passage 106 through second end 99 of window mill 80.

Figure 4:
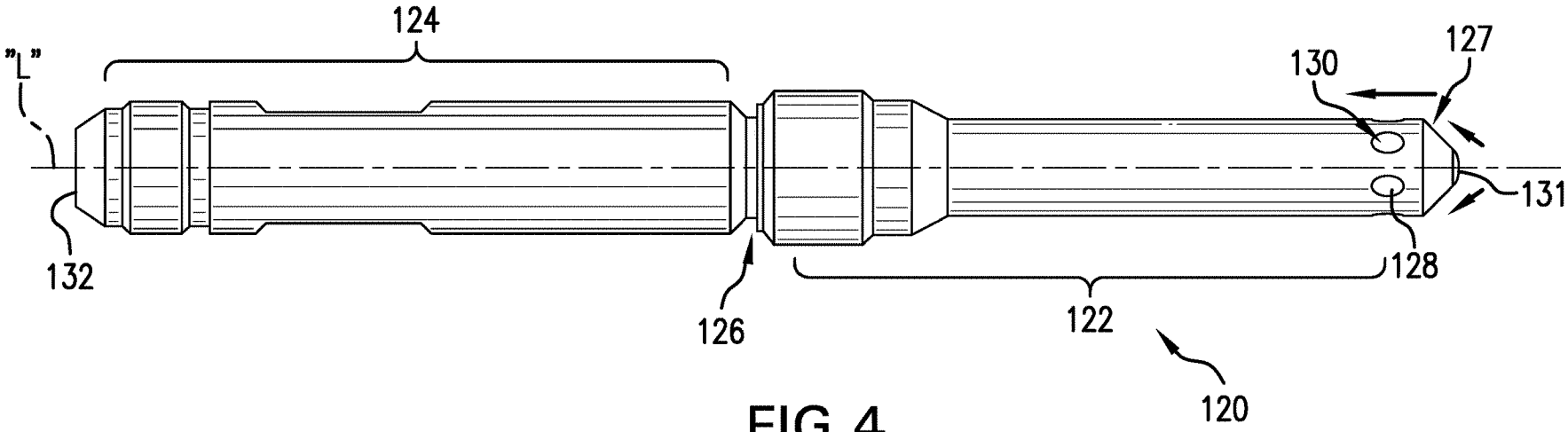
FIG. 4 depicts a plan view of the hydraulic line connector of FIG. 3.
Figure 5:
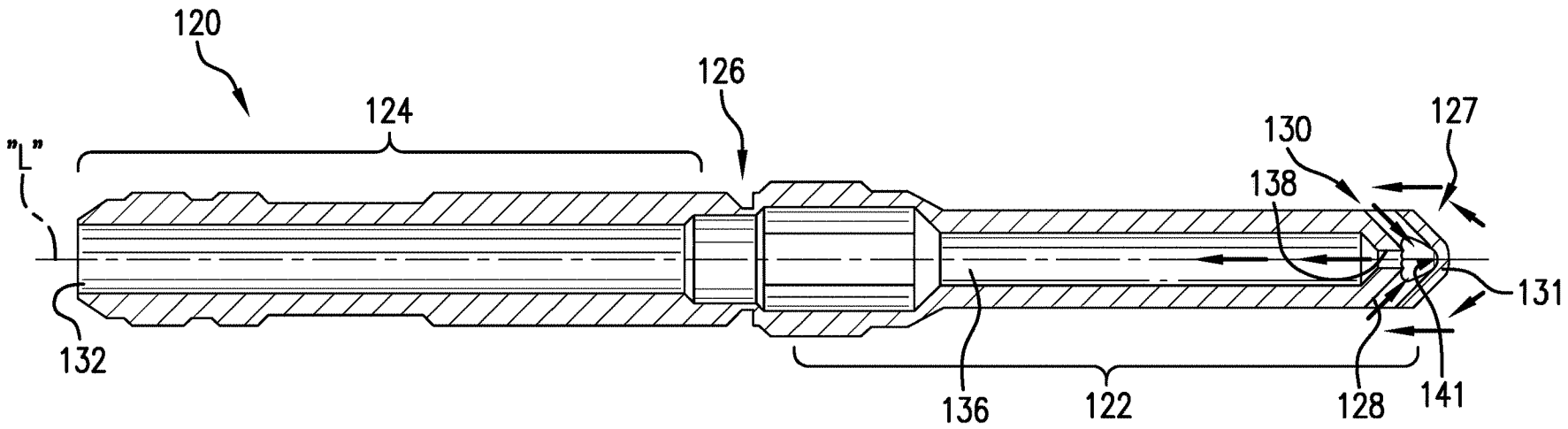
FIG. 5 depicts a cross-sectional view of the hydraulic line connector of FIG. 4.

In an embodiment, window mill 80 supports a hydraulic line connector 120 that provides an interface to a hydraulic line (not shown) that may carry fluid that passes from first system 12 through tubular string 30 into passage 106 and downhole to an anchor activation and/or setting system (also not shown) arranged at anchor 88. As shown in FIGS. 4 and 5, hydraulic line connector 120 includes a first portion 122 connected to a second portion 124 through a frangible zone 126. First portion 122 and second portion 124 lie along a longitudinal axis "L". Frangible zone 126 selectively fails when exposed to shear and/or tensile forces causing first portion 122 to separate from second portion 124 so window mill 80 may disconnect from whipstock connector 82.

In an embodiment, first portion 122 includes a terminal end 127 having a plurality of openings, one of which is indicated at 128 that define an inlet 130. Inlet 130 is radially offset relative to longitudinal axis "L", with the plurality of openings 128 extending at a non-perpendicular angle relative to longitudinal axis "L". The non-perpendicular angle is an acute angle having an apex at terminal end 127. Terminal end 127 includes a tapered surface 131 defining a tapered end (not separately labeled). An outlet 132 is arranged at an opposing terminal end (not separately labeled) on second portion 124. A flow path 136 extends between inlet 130 and outlet 132.

An inlet port 138 is provided at first portion 122 on longitudinal axis "L". Inlet port 138 is spaced from terminal end 129. With this arrangement, plurality of openings 128 and inlet port 138 create a flow redirection zone that forms a debris filter 141 in terminal end 127. By redirecting the fluid flow, debris may accumulate in terminal end 127 and not pass into flow path 136. In addition, the flow redirection zone causes a back flow in passage 106. That is, fluid passing into window mill 80 flows toward opening 112 and is then redirected back to inlet 130 thereby forming a debris trap in passage 106. By filtering debris in window mill 80 and at terminal end 127 fluid may pass unrestricted through hydraulic connector 120.

Figure 6:
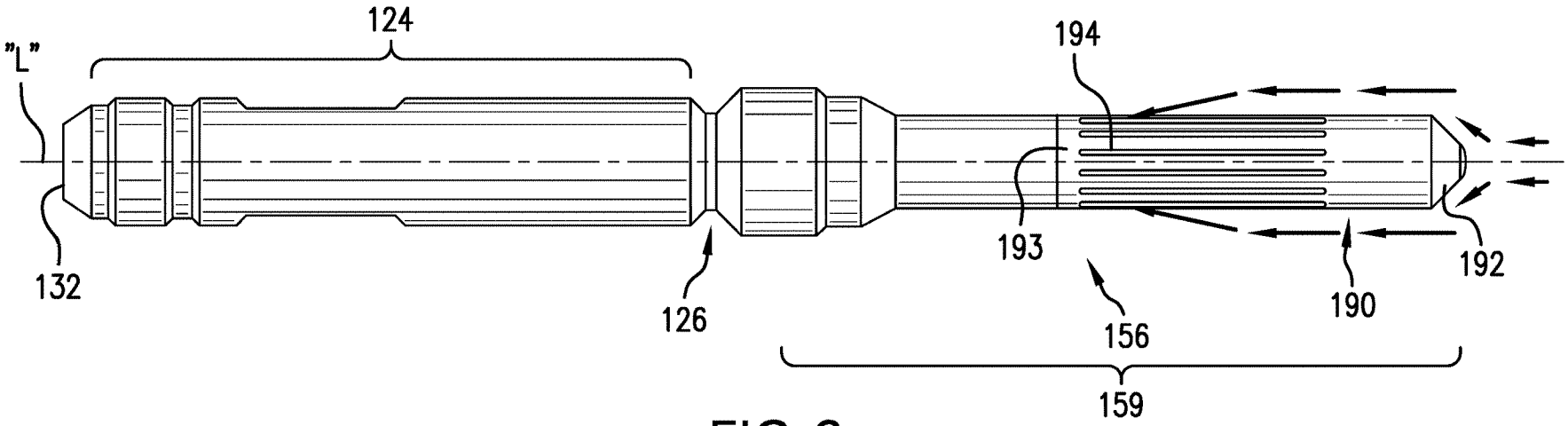
FIG. 6 depicts a plan view of a hydraulic line connector, in accordance with another aspect of an exemplary embodiment.
Figure 7:
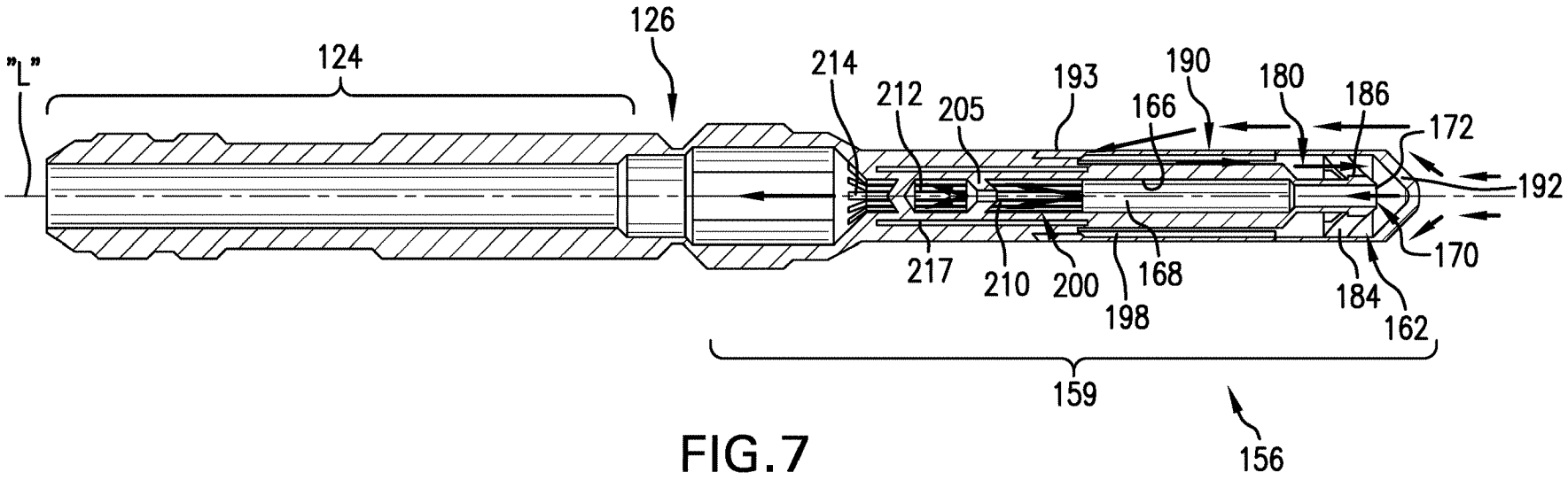
FIG. 7 depicts a cross-sectional view of the hydraulic line connector of FIG. 6.
Figure 8:
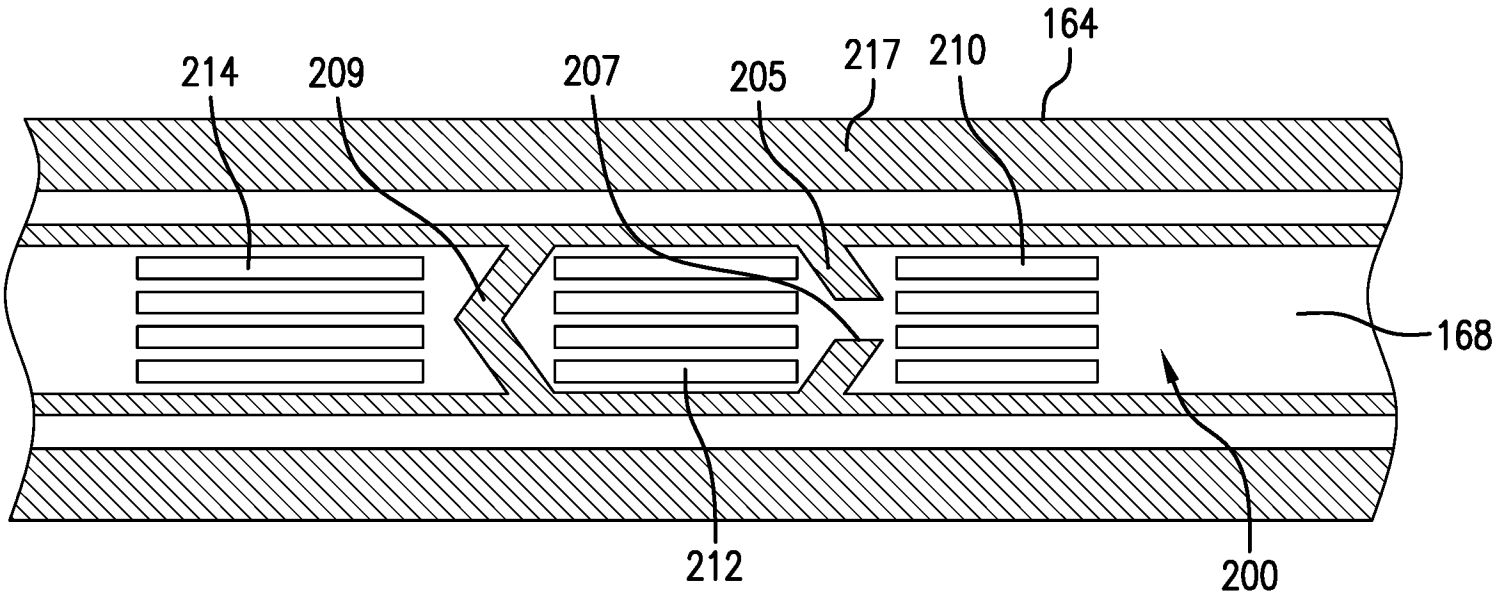
FIG. 8 depicts a detail view of a portion of the hydraulic line connector of FIG. 7.

Reference will now follow to FIGS. 6-8, wherein like reference numbers represent corresponding parts in the respective views, in describing a hydraulic connector 156 in accordance with another exemplary aspect. Hydraulic connector 156 includes a first portion 159 having a terminal end 162, an outer surface 164, and an inner surface 166 that defines a flow path 168. Terminal end 162 includes an opening 170 that is positioned along with longitudinal axis "L". Opening 170 defines an inlet 172. Terminal end 162 also includes a recess 180 that defines a ring element 184 having one or more openings 186 that are positioned radially outwardly of, and parallel to, longitudinal axis "L".

Hydraulic line connector 156 also includes a cover 190 having a tapered end 192 and an annular surface 193 including a plurality of slotted openings 194. Slotted openings 194, in a manner similar to that discussed herein, creates a flow redirection forming a debris filter 198 that is spaced from inlet 172. That is, debris may collect between cover 190 and outer surface 164 and not pass into inlet 172. In addition, hydraulic line connector 156 includes a plurality of er elements 200 arranged along flow path 168.

Referring to FIG. 8, filter elements 200 includes a flow restrictor 205 having a passage 207 and a dam 209 that extends across flow path 169. A first plurality of openings 210 are arranged axially outwardly of flow restrictor 205 toward terminal end 162, a second plurality of openings 212 are arranged between flow restrictor 205 and dam 209, and a third plurality of openings 214 are arranged axially outwardly of dam 209 toward second portion 124. Openings 210, 21, and 214 lead to a cavity 217 arranged radially outwardly of flow path 168. Flow restrictor 205 causes a portion of fluid passing through flow path 168 to flow into cavity 217. Another portion of the fluid flows toward dam 209 and is directed through openings 212 forming a serpentine flow path. The fluid combines in cavity 217 and flows back into flow path 168 via openings 214. This serpentine flow path filters out additional debris that may otherwise pass through outlet 132.

Figure 9:
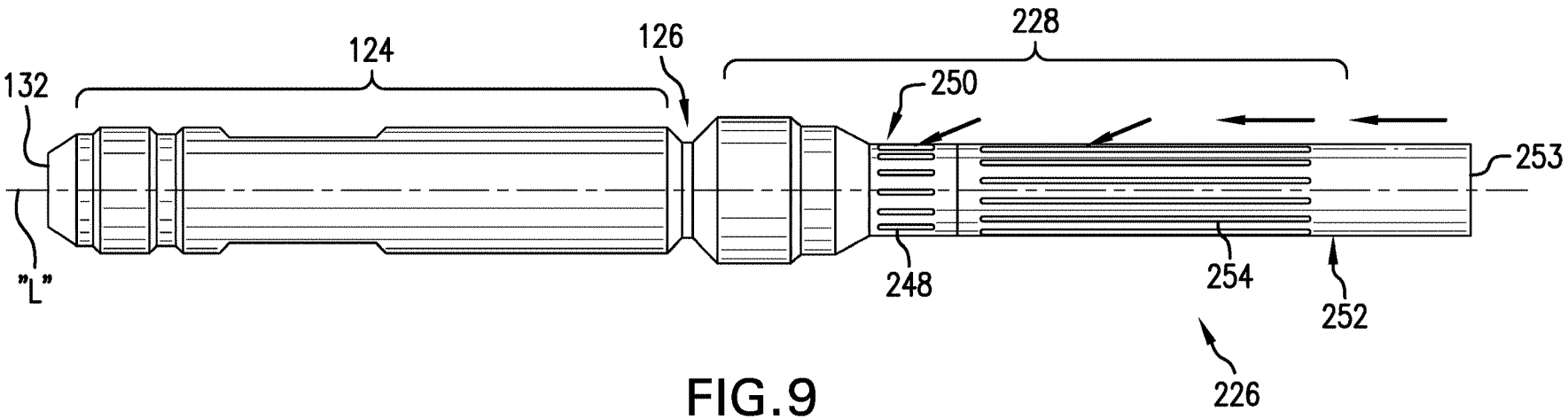
FIG. 9 depicts a plan view of a hydraulic line connector, in accordance with yet another aspect of an exemplary embodiment.
Figure 10:
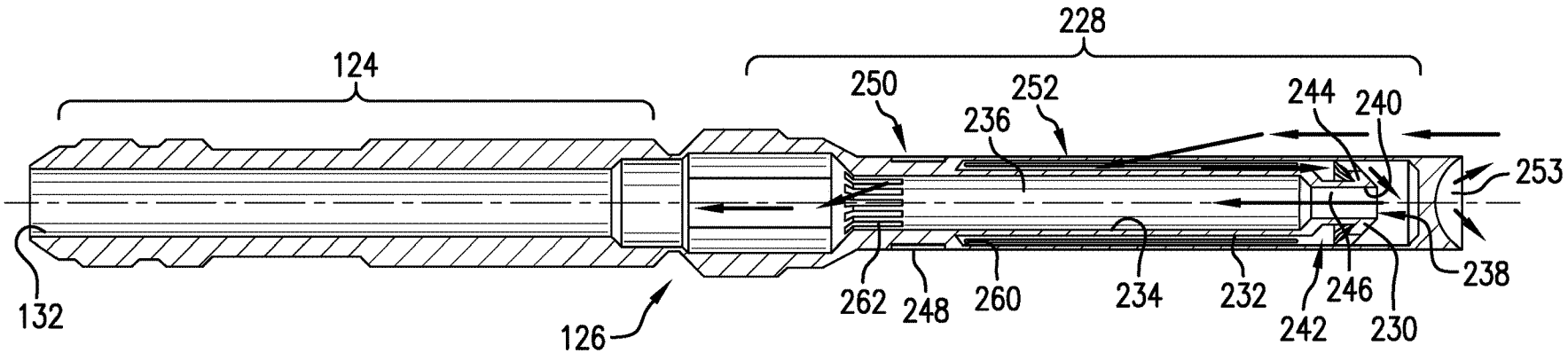
FIG. 10 depicts a cross-sectional view of the hydraulic line connector of FIG. 9.

Reference will now follow to FIGS. 9 and 10, wherein like reference numbers represent corresponding parts in the respective views, in describing a hydraulic line connector 226 in accordance with yet another aspect of an exemplary embodiment. Hydraulic line connector 226 includes a first portion 228 having a terminal end 230, an outer surface 232, and an inner surface 234 that defines a flow path 236. Terminal end 230 includes an opening 238 provided on longitudinal axis "L" that defines an inlet 240, Terminal end 230 also includes a recess 242 that defines a ring element 244 including one or more openings 246 that are spaced radially outwardly of, and parallel to, longitudinal axis "L". Additional openings 248 define a secondary inlet 250 that provides a pathway to flow path 236 bypassing inlet 240 as will be discussed herein.

Hydraulic line connector 226 also includes a cover 252 having a terminal end portion 253 having a concave surface and a plurality of slotted openings 254. Slotted openings 254, in a manner similar to that discussed herein, create a flow redirection forming a debris filter 260 that is spaced from inlet 240. That is, debris may collect between cover 252 and outer surface 232 and not pass into inlet 240. Additional openings 262 are arranged along flow path 268 and fluidically connect with secondary inlet 250.

At this point, it should be understood, that the exemplary embodiments describe a hydraulic line connector that includes filtering features to strain and/or trap debris that may be present in fluid passing through a mill bit to activate and/or set a downhole device such as an anchor. In addition, the hydraulic connector includes a frangible zone that may be selectively broken when exposed to shear and/or tensile forces. In this manner, the hydraulic connector may be separated into at least two portions allowing the mill to be separated from a whipstock connector and operated to form a casing window.

Set forth below are some embodiments of the foregoing disclosure:

Embodiment 1. A window mill comprising: a body having a first end, a second end, and an intermediate portion extending therebetween; a passage formed in the body extending from the first end toward the second end; an opening extending through the second end and fluidically connected to the passage; and a hydraulic line connector extending through the opening into the passage, the hydraulic line connector including a first portion having an inlet arranged in the passage, a second portion that projects outwardly of the second end of the body, a longitudinal axis defined between the first portion and the second portion, and a frangible zone arranged between the first portion and the second portion, wherein at least one of the first portion and the second portion includes a debris filter.

Embodiment 2. The window mill according to any prior embodiment, wherein the inlet includes a plurality of openings extending through the first portion at an angle relative to the longitudinal axis.

Embodiment 3. The window mill according to any prior embodiment, further comprising: an inlet port arranged within the first portion, each of the plurality of openings being fluidically connected to the inlet port.

Embodiment 4. The window mill according to any prior embodiment, wherein the first portion includes a tapered end, the plurality of openings extending into the tapered end.

Embodiment 5. The window mill according to any prior embodiment, wherein the frangible zone includes a recess extending radially inwardly into the intermediate portion.

Embodiment 6. The window mill according to any prior embodiment, wherein the first portion includes a terminal end, an outer surface, an inner surface defining a passage extending along the longitudinal axis, and an opening extending through the terminal end, the opening being fluidically connected to the passage.

Embodiment 7. The window mill according to any prior embodiment, further comprising: a recess formed in the outer surface, the recess defining a ring element that extends about the terminal end, the ring element including one or more openings.

Embodiment 8. The window mill according to any prior embodiment, further comprising: one or more filter elements arranged in the passage.

Embodiment 9. The window mill according to any prior embodiment, further comprising: a cover including a plurality of openings extending over the terminal end of the first portion, the cover being spaced from the outer surface.

Embodiment 10. The window mill according to any prior embodiment, wherein the plurality of openings in the cover comprise slotted openings that extend along the cover parallel to the longitudinal axis.

Embodiment 11. The window mill according to any prior embodiment, wherein the cover includes a terminal end portion having a concave surface.

Embodiment 12. A resource exploration and recovery system comprising: a first system; a second system including a tubular string fluidically connected to the first system and extending into a wellbore, the tubular string supporting a window mill comprising: a body having a first end, a second end, and an intermediate portion extending therebetween; a passage formed in the body extending from the first end toward the second end; an opening extending through the second end and fluidically connected to the passage; and a hydraulic line connector extending through the opening into the passage, the hydraulic line connector including a first portion having an inlet arranged in the passage, a second portion that projects outwardly of the second end of the body, a longitudinal axis defined between the first portion and the second portion, and a frangible zone arranged between the first portion and the second portion, wherein at least one of the first portion and the second portion includes a debris filter.

Embodiment 13. The window mill according to any prior embodiment, wherein the inlet includes a plurality of openings extending through the first portion at an angle relative to the longitudinal axis.

Embodiment 14. The window mill according to any prior embodiment, further comprising: an inlet port arranged within the first portion, each of the plurality of openings being fluidically connected to the inlet port.

Embodiment 15. The window mill according to any prior embodiment, wherein the first portion includes a tapered end, the plurality of openings extending into the tapered end.

Embodiment 16. The window mill according to any prior embodiment, wherein the frangible zone includes a recess extending radially inwardly into the intermediate portion.

Embodiment 17. The window mill according to any prior embodiment, wherein the first portion includes a terminal end, an outer surface, an inner surface defining a passage extending along the longitudinal axis, and an opening extending through the terminal end, the opening being fluidically connected to the passage.

Embodiment 18. The window mill according to any prior embodiment, further comprising: a recess formed in the outer surface, the recess defining a ring element that extends about the terminal end, the ring element including one or more openings.

Embodiment 19. The window mill according to any prior embodiment, further comprising: a cover including a plurality of openings extending over the terminal end of the first portion, the cover being spaced from the outer surface.

Embodiment 20. The window mill according to any prior embodiment, wherein the cover includes a terminal end portion having a concave surface.

The terms "about" and "substantially" are intended to include the degree of error associated with measurement of the particular quantity based upon the equipment available at the time of filing the application. For example, "about" and/or "substantially" can include a range of ±8% or 5%, or 2% of a given value.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A window mill comprising:

a body having a first end, a second end, and an intermediate portion extending therebetween;

a passage formed in the body extending from the first end toward the second end;

an opening extending through the second end and fluidically connected to the passage; and a hydraulic line connector extending through the opening into the passage, the hydraulic line connector including a first portion having an inlet arranged in the passage, a second portion that projects outwardly of the second end of the body, a longitudinal axis defined between the first portion and the second portion, and a frangible zone arranged between the first portion and the second portion, the frangible zone including a recess extending radially inwardly into the intermediate portion, wherein at least one of the first portion and the second portion includes a debris filter.

2. The window mill according to claim 1, wherein the inlet includes a plurality of openings extending through the first portion at a non-zero angle relative to the longitudinal axis.

3. The window mill according to claim 2, further comprising: an inlet port arranged within the first portion, each of the plurality of openings being fluidically connected to the inlet port.

4. The window mill according to claim 2, wherein the first portion includes a tapered end, the plurality of openings extending into the tapered end.

5. The window mill according to claim 1, wherein the first portion includes a terminal end, an outer surface, an inner surface defining a passage extending along the longitudinal axis, and an opening extending through the terminal end, the opening being fluidically connected to the passage.

6. The window mill according to claim 5, further comprising: a recess formed in the outer surface, the recess defining a ring element that extends about the terminal end, the ring element including one or more openings.

7. The window mill according to claim 6, further comprising: one or more filter elements arranged in the passage.

8. The window mill according to claim 5, further comprising: a cover including a plurality of openings extending over the terminal end of the first portion, the cover being spaced from the outer surface.

9. The window mill according to claim 8, wherein the plurality of openings in the cover comprise slotted openings that extend along the cover parallel to the longitudinal axis.

10. The window mill according to claim 8, wherein the cover includes a terminal end portion having a concave surface.

11. A resource exploration and recovery system comprising:

a first system;

a second system including a tubular string fluidically connected to the first system and extending into a wellbore, the tubular string supporting a window mill comprising:

a body having a first end, a second end, and an intermediate portion extending therebetween;

a passage formed in the body extending from the first end toward the second end;

an opening extending through the second end and fluidically connected to the passage; and a hydraulic line connector extending through the opening into the passage, the hydraulic line connector including a first portion having an inlet arranged in the passage, a second portion that projects outwardly of the second end of the body, a longitudinal axis defined between the first portion and the second portion, and a frangible zone arranged between the first portion and the second portion, the frangible zone includes a recess extending radially inwardly into the intermediate portion, wherein at least one of the first portion and the second portion includes a debris filter.

12. The window mill according to claim 11, wherein the inlet includes a plurality of openings extending through the first portion at a non-zero angle relative to the longitudinal axis.

13. The window mill according to claim 12, further comprising: an inlet port arranged within the first portion, each of the plurality of openings being fluidically connected to the inlet port.

14. The window mill according to claim 12, wherein the first portion includes a tapered end, the plurality of openings extending into the tapered end.

15. The window mill according to claim 11, wherein the first portion includes a terminal end, an outer surface, an inner surface defining a passage extending along the longitudinal axis, and an opening extending through the terminal end, the opening being fluidically connected to the passage.

16. The window mill according to claim 15, further comprising: a recess formed in the outer surface, the recess defining a ring element that extends about the terminal end, the ring element including one or more openings.

17. The window mill according to claim 15, further comprising: a cover including a plurality of openings extending over the terminal end of the first portion, the cover being spaced from the outer surface.

18. The window mill according to claim 17, wherein the cover includes a terminal end portion having a concave surface.

* * * * *